US009640903B2

(12) United States Patent
Yamada et al.

(10) Patent No.: US 9,640,903 B2
(45) Date of Patent: May 2, 2017

(54) REAR HOLDER CAPABLE OF ABSORBING DIMENSIONAL VARIATIONS IN ELECTRIC WIRES

(71) Applicant: YAZAKI CORPORATION, Tokyo (JP)

(72) Inventors: Yuya Yamada, Kakegawa (JP); Hidehiko Kuboshima, Kakegawa (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 15/161,449

(22) Filed: May 23, 2016

(65) Prior Publication Data

US 2016/0268727 A1 Sep. 15, 2016

Related U.S. Application Data

(63) Continuation of application No. PCT/JP2014/084705, filed on Dec. 26, 2014.

(30) Foreign Application Priority Data

Dec. 26, 2013 (JP) ..... 2013-269358

(51) Int. Cl.
*H01R 13/58* (2006.01)

(52) U.S. Cl.
CPC ..... *H01R 13/5825* (2013.01)

(58) Field of Classification Search
CPC ..... H01R 13/5221; H01R 13/506; H01R 13/5812; H01R 13/59; H01R 13/595;
(Continued)

(56) References Cited

U.S. PATENT DOCUMENTS 5,622,512 A * 4/1997 Uchida ..... H01R 13/5219 439/271
6,056,586 A * 5/2000 Lin ..... H01R 13/582 439/460

(Continued)

FOREIGN PATENT DOCUMENTS

JP 2012-511804 A 5/2012
JP 2012-185960 A 9/2012

OTHER PUBLICATIONS

Written Opinion, issued by International Searching Authority in corresponding International Application No. PCT/JP2014/084705, mailed on Mar. 31, 2015.(PCT/ISA/237).

(Continued)

*Primary Examiner* — Thanh Tam Le
(74) *Attorney, Agent, or Firm* — Sughrue Mion, PLLC

(57) ABSTRACT

A rear holder is attached to a wire lead-out opening for leading out an electric wire from a housing. The rear holder includes an inner holder. An inner circumferential surface of a through hole of the rear holder is formed so that a part of the inner circumferential surface includes a small diameter portion and the remaining part includes a large diameter portion. A hood portion having an arc shape is provided in the inner holder, and the hood portion is formed so that, in a state that the inner holder is assembled to the rear holder, the hood portion is inserted into the large diameter portion while each of opposite circumferential ends of the hood portion abuts against a step surface in a border between the large diameter portion and the small diameter portion.

4 Claims, 5 Drawing Sheets

(58) Field of Classification Search
CPC ..... H01R 13/5804; H01R 13/5208; H01R 13/5205; H01R 13/514
USPC ..... 439/274, 459–462, 469–472, 587, 589, 439/701
See application file for complete search history.

(56) References Cited

U.S. PATENT DOCUMENTS 6,149,455 A * 11/2000 Levi ..... H01R 13/59 439/321
6,508,669 B2 * 1/2003 Wang ..... H01R 13/59 439/353
6,582,248 B2 * 6/2003 Bachman ..... H01R 13/516 439/447
7,285,014 B2 * 10/2007 Castaldo ..... H01R 13/5205 439/587
7,479,027 B1 * 1/2009 Miller ..... H01R 13/506 439/461
7,578,695 B2 * 8/2009 Boeck ..... H01R 13/5804 439/460
7,621,772 B1 * 11/2009 Tobey ..... H01R 13/58 174/660
7,762,842 B2 * 7/2010 Deubel ..... H01R 13/5208 439/589
8,038,475 B2 * 10/2011 Kameyama ..... H01R 13/502 439/607.51
8,109,789 B2 * 2/2012 Tyler ..... H01R 13/5205 439/587
8,684,763 B2 * 4/2014 Mattson ..... H01R 13/58 439/447
2010/0151721 A1 6/2010 Tyler
2013/0337693 A1 12/2013 Mori

OTHER PUBLICATIONS

International Search Report , issued by International Searching Authority in corresponding International Application No. PCT/JP2014/084705, mailed on Mar. 31, 2015.(PCT/ISA/210).
Written Opinion dated Mar. 31, 2015 issued by the International Searching Authority in International Application No. PCT/JP2014/084705.

* cited by examiner

REAR HOLDER CAPABLE OF ABSORBING DIMENSIONAL VARIATIONS IN ELECTRIC WIRES

CROSS REFERENCE TO RELATED APPLICATIONS

This application is a continuation of PCT application No. PCT/JP2014/084705, which was filed on Dec. 26, 2014 based on Japanese Patent Application (No. P2013-269358) filed on Dec. 26, 2013, the contents of which are incorporated herein by reference.

BACKGROUND OF THE INVENTION

1. Field of the Invention

The present invention relates to a rear holder.

2. Description of the Related Art

In a related art connector including a cylindrical housing and a connector terminal inserted into the housing, there has been known a structure that a rear holder is attached to a wire lead-out opening at one end of the housing so that an electric wire connected to the connector terminal can be led out through a through hole of the rear holder (see JP-A-2012-185960).

According to the rear holder, the electric wire is inserted into the through hole smaller than the wire lead-out opening of the housing so that motion of the electric wire can be restricted. Thus, for example, the electric wire can be prevented from being damaged, or the connector terminal can be prevented from slipping off from the housing due to the motion of the electric wire.

In recent years, such a connector using a rear holder is often used in a part where electric wires of a wire harness mounted in an electric car, a hybrid car or the like are connected to each other.

A high voltage cable or the like is used as such an electric wire mounted on a car. For example, a measure taken to prevent foreign substances from invading the housing from a gap between the inner circumferential surface of the through hole of the rear holder and the outer circumferential surface of the high voltage cable passing through the through hole is requested in order to secure desired safety. For example, IP (International Protection) standards may be used as criteria for determining the safety of the connector. In order to satisfy requirements of the IP standards, it is, for example, required that, when a wire of a predetermined thickness (e.g. $\phi 1$ mm) is inserted into a gap between the inner circumferential surface of the through hole of the rear holder and the outer circumferential surface (insulating jacket) of the high voltage cable passing through the through hole, the wire cannot touch a live part such as a connector terminal through the gap.

However, the size of the gap changes in accordance with a variation in outer diameter of the electric wire, a variation in hole diameter of the through hole of the rear holder, etc. According, it is, for example, necessary to set the hole diameter of the through hole of the rear holder to be smaller in consideration of those variations. However, when the through hole is set to be smaller, a load with which an electric wire formed with a large outer diameter is inserted into the through hole of the rear holder increases to lower the working efficiency.

There is known another structure in which a rear holder is formed as a pair of half cylindrical parts divided axially, and the rear holder holding an electric wire between the half cylindrical parts is inserted and fixed to a wire lead-out opening of a housing. However, even in such a rear holder, for example, when the electric wire is formed with a large outer diameter, a load with which the rear holder is inserted into the wire lead-out opening of the housing may increase to lower the working efficiency.

SUMMARY OF THE INVENTION

The present invention has been developed in consideration of the aforementioned problems. An object of the invention is to make it possible to easily perform assembling work in spite of dimensional variations of components, and to secure desired safety.

In order to solve the foregoing problems, the invention has the following configurations.

(1) A rear holder that is attached to a wire lead-out opening for leading out an electric wire from a housing which receives a connector terminal to which the electric wire is connected, so that the electric wire is allowed to be led out to the outside through a through hole of the rear holder, the rear holder including an inner holder that is located on a housing side of the rear holder and is assembled to the rear holder; wherein: an inner circumferential surface of the through hole is formed so that a part of the inner circumferential surface in a circumferential direction thereof includes a small diameter portion and the remaining part of the inner circumferential surface includes a large diameter portion whose inner diameter is larger than that of the small diameter portion; and a hood portion having an arc shape in cross section and formed in a circumferential direction of the electric wire is provided in the inner holder, and the hood portion is formed so that, in a state that the inner holder is assembled to the rear holder, the hood portion is inserted into the large diameter portion while each of opposite circumferential ends of the hood portion can abut against step surfaces in a border between the large diameter portion and the small diameter portion.

According to the aforementioned configuration (1), for example, when the inner diameter of the small diameter portion is set in accordance with the outer diameter size of the electric wire, a space inside the through hole can be increased correspondingly to the large diameter portion formed therein. Thus, even when dimensional variations occur in components, a load in insertion work of the electric wire can be reduced. Further, although the hood portion is inserted into the large diameter portion of the through hole, the hood portion can be inserted by itself when the inner holder is fitted to the rear holder. Thus, there occurs no load in assembling work.

In addition, when the opposite ends of the hood portion are brought into abutment against the step surfaces, the outer circumferential surface of the electric wire is entirely circumferentially enclosed by the inner circumferential surface of the small diameter portion and the inner circumferential surface of the hood portion. Therefore, when the sizes of those inner circumferential surfaces are set suitably, the gap between each inner circumferential surface and the outer circumferential surface of the electric wire can be reduced. As a result, requirements of the IP standards or the like can be satisfied to secure desired safety.

(2) The rear holder according to the aforementioned configuration (1), wherein the inner holder is formed so that the hood portion inserted into the large diameter portion is configured to press an outer circumferential surface of the electric wire.

According to the aforementioned configuration (2), the hood portion presses the electric wire so that the electric wire can be brought into abutment against the inner circumferential surface of the small diameter portion. Thus, the gap between the through hole and the electric wire can be made smaller.

(3) The rear holder according to the aforementioned configuration (1) or (2), wherein the inner holder includes a pair of foot portions that are formed continuously to a base end of the hood portion so that the foot portions extend along a circumferential edge of the small diameter portion of the through hole when the inner holder is assembled to the rear holder.

According to the aforementioned configuration (3), when the hood portion is pushed by the electric wire to generate a gap between an end portion of the hood portion and a corresponding one of the step surfaces of the through hole, for example, due to external force acting on the electric wire in a bending direction, the foot portions are provided behind the gap so as to block the gap. It is therefore possible to prevent a wire from invading the housing through the gap in a test according to the IP standards.

(4) A rear holder according to any one of the aforementioned configurations (1) through (3), wherein an inclined surface is formed at a circumferential edge of the through hole on the housing side so as to extend along the large diameter portion.

According to the aforementioned configuration (4), the hood portion can be guided into the through hole when the inner holder is fitted to the rear holder. Thus, the hood portion can be inserted smoothly so that the assemblability of the inner holder can be improved. In addition, the hood portion can be prevented from abutting against the circumferential edge of the through hole to be thereby damaged.

According to the invention, it is possible to easily perform assembling work in spite of dimensional variations of components, and it is possible to secure desired safety.

DETAILED DESCRIPTION OF THE EXEMPLARY EMBODIMENTS

Figure 1:
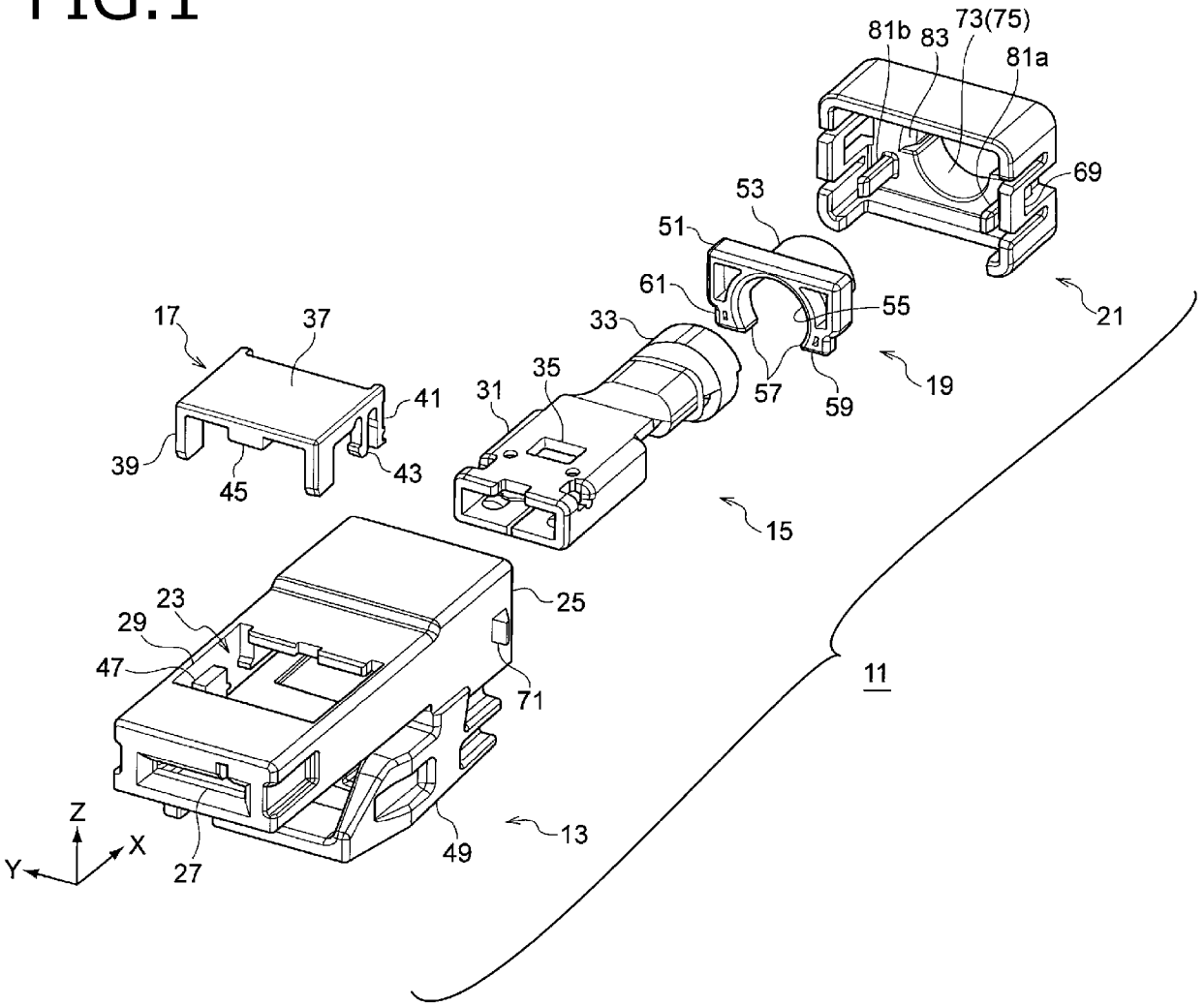
FIG. 1 is an exploded perspective view of a connector to which a rear holder according to an embodiment of the invention is applied.
Figure 2:
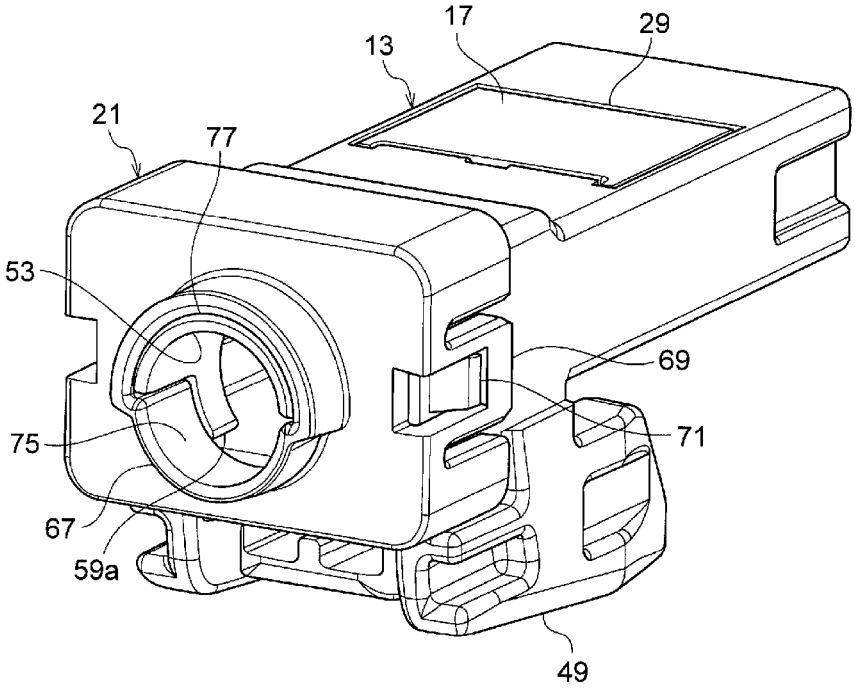
FIG. 2 is a perspective view in which the connector is observed from the rear.

An embodiment of a connector to which a rear holder according to the invention is applied will be described below with reference to the drawings. FIG. 1 is an exploded perspective view of the connector according to the embodiment of the invention. FIG. 2 is a perspective view in which the connector is observed from the rear.

A connector 11 is provided at a terminal of a not-shown single electric wire. The connector 11 is used for connection with a partner-side electric wire. The connector 11 includes a housing 13, a connector terminal 15, a retention member 17, an inner holder 19 and a rear holder 21. When the inner holder 19 is located on the housing side of the rear holder 21, the inner holder can be fitted to the rear holder 21. In the following description, the arrow X in FIG. 1 is defined as a front/rear direction (the front side of the paper is regarded as the front), the arrow Y is defined as a left/right direction or a width direction, and the arrow Z is defined as an up/down direction (the upper side of the paper is regarded as the upper). Those definitions can be also applied to description of the other drawings.

The housing 13 is formed out of synthetic resin with insulating properties, and shaped into a rectangular cylinder having a substantially rectangular shape in section. A terminal reception chamber 23 shaped into a rectangular parallelepiped long in the front/rear direction is formed inside the housing 13. The connector terminal 15 can be inserted into the terminal reception chamber 23 through a wire lead-out opening 25 located at the rear of the housing 13 while a not-shown partner-side terminal can be inserted into the terminal reception chamber 23 through a terminal insertion port 27 located at the front of the housing 13. In addition, the electric wire connected to the connector terminal 15 received in the terminal reception chamber 23 can be extracted from the housing 13 through the wire lead-out opening 25. The terminal insertion port 27 is formed to be comparatively small and to penetrate a part of a front end surface of the housing 13. On the other hand, the wire lead-out opening 25 is formed into a comparatively large rectangular shape surrounded by end portions of cylindrical walls of the four sides forming the housing 13. Incidentally, the housing 13 is not limited to the rectangular cylindrical shape but may be, for example, formed into a circular cylindrical shape.

An opening 29 is formed in the housing 13 so as to penetrate the upper cylindrical wall of the housing 13 rectangularly. The retention member 17 made of synthetic resin is attached to the opening 29. The retention member 17 is a member by which the connector terminal 15 received in the housing 13 can be retained in the housing 13. When the retention member 17 is attached to the housing 13, the opening 29 can be closed as shown in FIG. 2.

The connector terminal 15 has an electric contact portion 31, and an electric connection portion 33 having a circular cylindrical shape. The electric connection portion 33 is continuously connected to the electric contact portion 31. The electric contact portion 31 is formed out of a plate material made of metal and bent into a rectangular cylindrical shape, so that a tab-like electric contact portion of a partner-side terminal can be plugged into the electric contact portion 31. The electric connection portion 33 is formed out of a metal plate material bent into a circular shape in section, so that the electric connection portion 33 can enclose and crimp a conductor exposed from an insulating jacket of an electric wire and the insulating jacket. A concave portion 35 is formed in the upper surface of the electric contact portion 31 of the connector terminal 15.

The retention member 17 has a base portion 37, a pair of support pieces 39, a pair of temporary lock pieces 41, a pair of final lock pieces 43, and a protrusion portion 45. The retention member 17 is formed symmetrically. The support pieces 39, the temporary lock pieces 41 and the final lock pieces 43 are formed to protrude from the lower surface of the base portion 37 and in parallel with each other. The retention member 17 is attached to the housing 13 with the support pieces 39 facing the opening 29 as shown in FIG. 1.

The support pieces 39 are received along convex portions 47 of the inner walls of the housing 13. Thus, the support pieces 39 are guided into predetermined positions of the housing 13. As a result, the temporary lock pieces 41 are hooked on not-shown temporary lock portions of the housing 13 so that the base portion 37 can be temporarily locked to the housing 13. When the support pieces 39 are inserted more deeply, the final lock pieces 43 are hooked on no-shown final lock portions of the housing 13 so that the base portion 37 can be finally locked to the housing 13. Thus, the base portion 37 is attached to the opening 29 while the protrusion portion 45 is inserted into the concave portion 35 of the connector terminal 15 received in a predetermined position of the housing 13. When the protrusion portion 45 is inserted into the concave portion 35, the connector terminal 15 can be retained in the housing 13.

Incidentally, a locking arm 49 to which a partner connector can be fitted is formed under the housing 13. Since the locking arm 49 has a well-known configuration fundamentally, description thereof will be omitted.

Next, the configuration of the rear holder 21 that is a characteristic configuration of the embodiment will be described.

Figure 3:
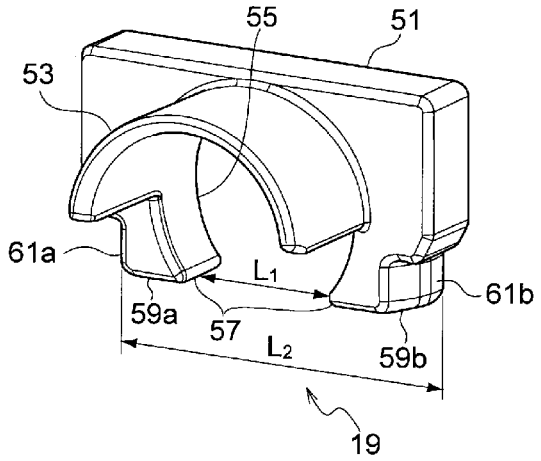
FIG. 3 is a perspective view in which an inner holder is observed from the rear.
Figure 4:
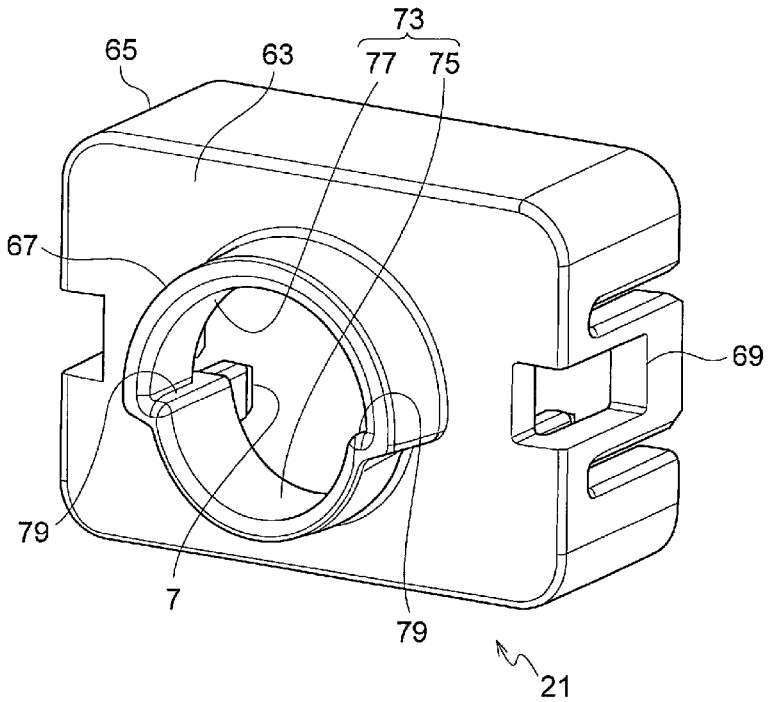
FIG. 4 is a perspective view in which the rear holder is observed from the rear.

The rear holder 21 according to the embodiment is used with the inner holder 19 fitted to the housing 13 side. FIG. 3 is a perspective view in which the inner holder 19 is observed from the rear. FIG. 4 is a perspective view in which the rear holder 21 is observed from the rear. The inner holder 19 is formed out of synthetic resin, applied to the outer circumferential surface (insulating jacket) of a not-shown electric wire, and fitted to the rear holder 21 in use. The rear holder 21 is formed out of synthetic resin. The rear holder 21 is a member by which the electric wire led out from the housing 13 can be held in the wire lead-out opening 25 of the housing 13. A rear end portion of the housing 13 can be capped with the rear holder 21.

As shown in FIG. 3, the inner holder 19 has a base portion 51 and a hood portion 53. The base portion 51 is shaped into a flat plate. The hood portion 53 protrudes from the base portion 51 toward the rear on the opposite side to the housing 13. The base portion 51 has a circular opening 55 and an open portion 57. The circular opening 55 penetrates the base portion 51 in the front/rear direction and has a circular shape in section. A part of the outer circumferential edge of the circular opening 55 is cut off to form the open portion 57. That is, the base portion 51 is formed to have a pair of foot portions 59*a* and 59*b* connected to the base end of the hoot portion 53 and extending along the circular opening 55. The foot portions 59 are positioned so that their one end portions are connected to each other and the other end portions are separated from each other. The open portion 57 is formed between the other end portions. A relief recess is formed in each foot portion 59. The hood portion 53 is formed like an arc in section and along the inner circumferential surface of the circular opening 55 so as to protrude axially from the circumferential edge portion of the substantially upper half of the circular opening 55. The hood portion 53 can enclose the outer circumferential surface of the electric wire circumferentially.

Of the circular opening 55, for example, about one fourth of the diameter in the up/down direction is cut off so that the open portion 57 can be formed in the lower. The circular opening 55 is formed to have a hole of a substantially true circle in its inner circumference so that the circular opening 55 can enclose the electric wire circumferentially. The inner diameter of the circular opening 55 is, for example, set within a tolerance range of the outer diameter (the outer diameter of the insulating jacket) of the electric wire. Width size L1 of the open portion 57 can be expanded and contracted by elastic deformation of the pair of foot portions 59*a* and 59*b*. Thus, the open portion 57 can be opened to fit an electric wire to the circular opening 55, and the inner holder 19 can move along the electric wire. The opposite side surfaces of the foot portions 59*a* and 59*b* on the opposite side to the open portion 57 are notched into stepped shapes to form engagement portions 61*a* and 61*b* respectively.

As shown in FIG. 4, the rear holder 21 is formed into a box-like shape that is open to the front. The rear holder 21 has a bottom portion 63, wall portions 65 and a cylindrical portion 67. The bottom portion 63 has a rectangular shape. The wall portions 65 are provided erectly to extend frontward (on the housing 13 side) from the edge portions of the sides of the bottom portion 63 respectively. The cylindrical portion 67 protrudes rearward from the bottom portion 63. Lock hooks 69 are formed on the left and right wall portions 65 respectively. The lock hooks 69 can be engaged with lock protrusions 71 formed on the exteriors of the left and right cylindrical walls of the housing 13.

A through hole 73 to which an electric wire can be inserted is formed at the center of the bottom portion 63. The through hole 73 communicates with the inside of the cylindrical portion 67. The inner circumferential surface of the cylindrical portion 67 is formed by axial extension of the inner circumferential surface of the through hole 73. That is, the inner circumferential surface of the through hole 73 and the inner circumferential surface of the cylindrical portion 67 have the same shape. In the following description, assume that the inner circumferential surface of the cylindrical portion 67 belongs to the through hole 73 unless otherwise specified.

The through hole 73 is formed so that the lower half, which is a circumferential part, includes a small diameter portion 75, and the remaining upper half includes a large diameter portion 77. The small diameter portion 75 and the large diameter portion 77 are formed into sectional shapes of semicircles, which have a common axis as their center but have different inner diameters from each other. The inner diameter of the small diameter portion 75 is set within a tolerance range of the outer diameter size of the electric wire, while the inner diameter of the large diameter portion 77 is set at a predetermined size larger than that of the small diameter portion 75. Step surfaces 79 are formed in border portions between the small diameter portion 75 and the large diameter portion 77, that is, between the opposite end portions of the small diameter portion 75 and the opposite end portions of the large diameter portion 77 respectively. The step surfaces 79 are formed to extend in the width direction of the rear holder 21. Incidentally, the regions where the small diameter portion 75 and the large diameter portion 77 are formed in the inner circumferential surface of the through hole 73 may be set suitably.

As shown in FIG. 1, at the circumferential edge of the through hole 73 on the housing 13 side of the rear holder 21, pressing portions 81*a* and 81*b* protruding frontward are provided on the width-direction opposite sides of the small diameter portion 75. The inner holder 19 is fitted to the inside between the pressing portions 81*a* and 81*b*. The pressing portions 81*a* and 81*b* are formed to extend in parallel to each other. When the inner holder 19 is fitted, the pressing portions 81*a* and 81*b* can be engaged with the engagement portions 61*a* and 61*b* of the foot portions 59*a* and 59*b* extending along the circumferential edge of the small diameter portion 75 of the through hole 73, respectively. The pressing portions 81*a* and 81*b* are formed so that they can press the foot portions 59*a* and 59*b* in directions to close the open portion 57.

When the inner holder 19 is fitted, the hood portion 53 of the inner holder 19 is inserted into the large diameter portion 77 of the through hole 73. The hood portion 53 is inserted to the rear end portion of the large diameter portion 77 as soon as the inner holder 19 is fitted to a set position of the rear holder 21. In addition, the opposite end portions of the hood portion 53 that has been inserted to the large diameter portion 77 can abut against the step surfaces 79 respectively. In the embodiment, when the opposite end portions of the hood portion 53 abut against the step surfaces 79 respectively, the inner circumferential surface of the small diameter portion 75 and the inner circumferential surface of the hood portion 53 are disposed substantially concentrically.

An inclined surface 83 is formed in the bottom portion 63 of the rear holder 21 so as to extend along the circumferential edge of the large diameter portion 77 on the housing 13 side (FIG. 1). Thus, when the inner holder 19 is fitted, the hood portion 53 inserted into the through hole 73 can be guided to the large diameter portion 77.

Figure 5:
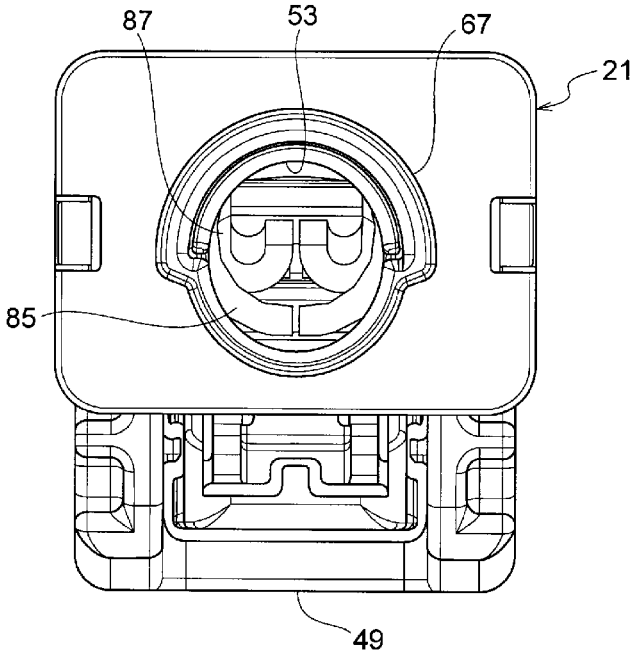
FIG. 5 is a back view in which the connector is observed from the rear.

As shown in FIG. 5, when the through hole 73 (the cylindrical portion 67) is observed from the rear, the rear holder 21 is formed to face, of the wire connection portion 33, a first connection portion 85 and a second connection portion 87. The first connection portion 85 crimps an insulating jacket of an electric wire, and the second connection portion 85 crimps a core exposed therefrom. The second connection portion 87 is disposed slightly above the lowermost portion of the inner circumferential surface of the through hole 73.

Next, the operation of the rear holder 21 will be mainly described in an example of the assembling procedure of the connector 11. First, an electric wire to which the connector terminal 15 has not been connected is inserted into the through hole 73 of the rear holder 21. Here, the large diameter portion 77 whose inner diameter is larger than the outer diameter of the electric wire has been formed in the through hole 73. Accordingly, dimensional variations in the electric wire and the through hole 73 can be absorbed by the large diameter portion 77. Thus, the electric wire can be inserted with an enough margin.

Next, the connector terminal 15 is connected to one end on the housing 13 side of the electric wire inserted into the through hole 73. The connector terminal 15 the electric wire has been connected to is inserted into the terminal reception chamber 23 through the wire lead-out opening 25 of the housing 13. When the retention member 17 temporarily locked to the housing 13 in advance is then pushed downward to be finally locked, the protrusion portion 45 is inserted into the concave portion 35 of the connector terminal 15 inserted into the terminal reception chamber 23. Thus, the connector terminal 15 is retained in the housing 13.

Figure 6:
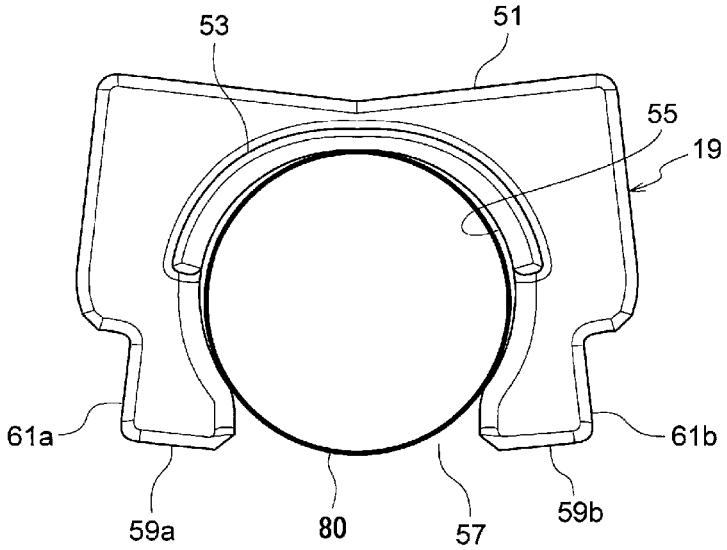
FIG. 6 is a plan view showing a state in which an electric wire has been inserted into the inner holder.

Next, the inner holder 19 is applied to the electric wire extracted from the wire lead-out opening 25 of the housing 13 and positioned in front of the rear holder 21. The foot portions 59*a* and 59*b* of the inner holder 19 are opened outward to expand the open portion 57 so that the electric wire 80 can be fitted to the circular opening 55 through the open portion 57. When the outer diameter of the electric wire 80 is larger than the inner diameter of the circular opening 55, the open portion 57 is deformed in a direction to expand outward as shown in FIG. 6 in the inner holder 19 the electric wire 80 has been fitted to. As a result, the hood portion 53 is also deformed in a direction to expand outward.

Next, the inner holder 19 is moved toward the housing 13 along the electric wire 80. Here, it is preferable that the inner holder 19 abuts against a predetermined position of the rear end portion (wire lead-out opening 25) of the housing 13 in advance. In this state, the rear holder 21 is pressed against the housing 13 so as to engage the left and right lock hooks 69 with the lock protrusions 71 of the housing 13 respectively. As a result, the housing 13 is capped with the rear holder 21 to which the inner holder 19 has been fitted on the housing 13 side.

When the housing 13 is capped with the rear holder 21, the hood portion 53 is received in the large diameter portion 77 of the through hole 73 of the rear holder 21 while the pressing portions 81*a* and 81*b* are fitted to the engagement portions 61 a and 61 b of the foot portions 59*a* and 59*b* respectively. Thus, the inner holder 19 is retained in the rear holder 21. When the rear holder 21 is pressed against the housing 13 in this manner, it is possible to concurrently perform the operation to cap the housing 13 with the rear holder 21 and the operation to insert the hood portion 53 into the through hole 73. Thus, the assembling work of components can be performed efficiently, and the assembling work can be simplified.

In addition, even if the hood portion 53 is placed out of position when the inner holder 19 is fitted, the hood portion 53 can be guided to the large diameter portion 77 along the inclined surface 83 at the circumferential edge of the through hole 73 so that the hood portion 53 can be inserted into the large diameter portion 77 smoothly. Thus, an insertion load can be reduced. In addition, due to the inclined surface 83 provided thus, the hood portion 53 can be prevented from abutting against the circumferential edge of the through hole 73 to be thereby damaged.

In addition, when the opposite end portions of the hood portion 53 inserted into the large diameter portion 77 abut against the step surfaces 79 respectively, deformation of the hood portion 53 as shown in FIG. 6 is corrected and restricted in a shape (shape before the deformation) in the circumferential direction of the outer circumference of the electric wire 80. Thus, in the through hole 73, all the circumference of the electric wire 80 is substantially uniformly enclosed with the inner circumferential surface of the through hole 73 of a substantially true circle formed out of the inner circumferential surface of the small diameter portion 75 and the inner circumferential surface of the hood portion 53.

Here, when the inner diameter of the small diameter portion 75, the inner diameter of the hood portion 53, and so on in the state where the hood portion 53 has been inserted into the through hole 73 are set suitably, the gap between the inner circumferential surface of the through hole 73 and the outer circumferential surface of the electric wire 80 can be eliminated. For example, the inner diameter of the small diameter portion 75 is set within a tolerance range of the outer diameter of the electric wire 80, and the inner diameter of the hood portion 53 is set at the lower limit of the tolerance of the outer diameter of the electric wire 80. In this manner, for example, even if the inner diameter of the small diameter portion 75 is formed to be larger, the electric wire 80 pressed onto the hood portion 53 can be pressed against the inner circumferential surface of the small diameter portion 75 because the hood portion 53 presses the outer circumferential surface of the electric wire 80. Thus, the gap between the through hole 73 and the electric wire 80 can be reduced. Therefore, in the connector 11 mounted on a vehicle or the like, foreign substances can be prevented from invading the housing 13, and desired safety can be secured.

That is, for example, a wire (for example, ϕ1 mm) can be prevented from passing through the through hole 73 in a test according to the IP standards. Thus, requirements by the IP standards can be satisfied.

Further, according to the embodiment, as described above, the opposite end portions of the hood portion 53 are brought into abutment against the step surfaces 79 to restrict deformation of the hood portion 53. Accordingly, even if external force in a bending direction acts on the electric wire 80 to thereby press the hood portion 53 onto the electric wire 80, a gap between the electric wire 80 and the through hole 73 can be suppressed from occurring due to the deformation of the hood portion 53.

On the other hand, for example, when the external force acting on the electric wire 80 in the bending direction is excessive, it can be considered that the hood portion 53 may be lifted up by the electric wire 80 to thereby separate an end portion of the hood portion 53 from a corresponding one of the step surfaces 79. When a gap is generated thus between the end portion of the hood portion 53 and the step surface 79, there is a fear that foreign substances may invade the inside of the housing 13 through the gap.

With respect to this point, according to the embodiment, the foot portions 59*a* and 59*b* of the inner holder 19 continuously connected to the base end of the hood portion 53 are disposed along the circumferential edge of the small diameter portion 75 of the through hole 73 as shown in FIG. 2. Accordingly, even when there occurs a gap between an end portion of the hood portion 53 and a corresponding one of the step surfaces 79, the gap can be blocked by the foot portion 59*a* or 59*b*. Thus, for example, even when a wire invades the gap in a test according to the IP standards, the wire abuts against the foot portion 59*a* or 59*b* behind the gap so that the wire can be prevented from invading the housing 13.

In addition, in the inner holder 19 that has been fitted, the pressing portions 81*a* and 81*b* are engaged with the foot portions 59*a* and 59*b*. Thus, the electric wire 80 is capped with the inner holder 19 that has been elastically deformed in a direction to close the open portion 57, that is, in a direction to press the electric wire 80. It is therefore also possible to restrict deformation of the hood portion 53 in the axial direction of the inner holder 19, so that it is possible to more surely preventing a gap from occurring between the electric wire 80 and the hood portion 53.

Incidentally, due to the open portion 57 formed in the inner holder 19, the outer circumferential surface of the electric wire 80 cannot be enclosed all over its circumference. However, as shown in FIG. 5, the first connection portion 85 is disposed in the lower facing the opening of the cylindrical portion 67, so that the first connection portion 85 can float upward. Accordingly, even if a wire of a smaller diameter invades a gap between the small diameter portion 75 and the electric wire 80 in a test according to the IP standards, the wire can be suppressed from touching the first connection portion 85.

The embodiment of the invention has been described in detail with reference to the drawings. The aforementioned embodiment is merely an exemplar of the invention. The invention is not limited only to the configuration of the aforementioned embodiment. It is a matter of course that any change on design or the like without departing from the gist of the invention is also included in the invention.

For example, although the embodiment has been described along an example in which the pair of foot portions 59*a* and 59*b* are provided in the inner holder 19, the foot portions 59*a* and 59*b* are not essential constituents. That is, members having other shapes extending downward from the base end of the hood portion 53 may be provided in the base portion 51 of the inner holder 19 in place of the foot portions 59*a* and 59*b*.

Incidentally, the invention is not limited to the aforementioned embodiment, but suitable deformations, improvements and so on may be made thereon. In addition, materials, shapes, dimensions, numbers, arrangement places, etc. of constituent elements in the aforementioned embodiment are not limited but may be selected desirably if the invention can be attained.

According to a rear holder of the invention, it is possible to easily perform assembling work in spite of dimensional variations of components, and it is possible to secure desired safety.

What is claimed is:

1. A rear holder that is attached to a wire lead-out opening for leading out an electric wire from a housing which receives a connector terminal to which the electric wire is connected, so that the electric wire is allowed to be led out to the outside through a through hole of the rear holder, the rear holder comprising:

an inner holder that is located between the housing and the rear holder and is assembled to the rear holder, wherein an inner circumferential surface of the through hole is formed so that a part of the inner circumferential surface in a circumferential direction thereof includes a small diameter portion and a remaining part of the inner circumferential surface includes a large diameter portion having an inner diameter is larger than that of the small diameter portion; and wherein a hood portion having an arc shape in cross section and formed in a circumferential direction of the electric wire is provided in the inner holder, and the hood portion is formed so that, in a state that the inner holder is assembled to the rear holder, the hood portion is inserted into the large diameter portion while each of opposite circumferential ends of the hood portion abuts against a step surface in a border between the large diameter portion and the small diameter portion.

2. The rear holder according to claim 1, wherein the inner holder is formed so that the hood portion inserted into the large diameter portion is configured to press an outer circumferential surface of the electric wire.

3. The rear holder according to claim 1, wherein the inner holder includes a pair of foot portions that are formed continuously to a base end of the hood portion so that the foot portions extend along a circumferential edge of the small diameter portion of the through hole when the inner holder is assembled to the rear holder.

4. The rear holder according to claim 1, wherein an inclined surface is formed at a circumferential edge of the through hole on the housing side so as to extend along the large diameter portion.

* * * * *